US008262076B2

(12) United States Patent
Wilson et al.

(10) Patent No.: US 8,262,076 B2
(45) Date of Patent: Sep. 11, 2012

(54) MEDIA DEPOSITORY

(75) Inventors: Owen Wilson, Kitchener (CA); Frank B. Dunn, Waterloo (CA)

(73) Assignee: NCR Corporation, Duluth, GA (US)

( * ) Notice: Subject to any disclaimer, the term of this patent is extended or adjusted under 35 U.S.C. 154(b) by 147 days.

(21) Appl. No.: 12/832,189

(22) Filed: Jul. 8, 2010

(65) Prior Publication Data

US 2012/0007304 A1 Jan. 12, 2012

(51) Int. Cl.
*B65H 5/22* (2006.01)

(52) U.S. Cl. ..... 271/3.01; 271/3.08; 271/10.01; 271/10.06

(58) Field of Classification Search ..... 271/3.01, 271/3.08, 10.01, 10.06, 34, 121, 126, 147; 902/15, 17

See application file for complete search history.

(56) References Cited

U.S. PATENT DOCUMENTS

| | | | | |
|---|---|---|---|---|
| 4,355,711 | A * | 10/1982 | Hirose | 194/206 |
| 5,927,936 | A * | 7/1999 | Arikawa et al. | 414/788 |
| 7,422,118 | B2 * | 9/2008 | Ugo et al. | 209/534 |
| 7,708,192 | B2 * | 5/2010 | Yokoi et al. | 235/379 |
| 2004/0251588 | A1 | 12/2004 | Panini | |
| 2005/0035531 | A1 * | 2/2005 | Sasaki et al. | 271/126 |
| 2009/0206541 | A1 * | 8/2009 | Nutzel et al. | 271/10.01 |

FOREIGN PATENT DOCUMENTS

| | | | |
|---|---|---|---|
| DE | 102008052694 | A1 | 4/2010 |
| EP | 0099250 | A1 | 1/1984 |

OTHER PUBLICATIONS

International Search Report for European Patent Application No. EP11139819.7, mailed Oct. 6, 2011.

* cited by examiner

*Primary Examiner* — David H Bollinger
(74) *Attorney, Agent, or Firm* — Paul W. Martin

(57) ABSTRACT

A bunch sheet depository is described. The depository comprises: a pressure plate for pressing on a bunch of sheets; a picker aligned with the pressure plate and arranged to remove sheets individually from the bunch of sheets; a link arm including (i) a pivot, (ii) an urging portion coupled to the pressure plate and (iii) a resilient member; and an actuator coupled to the resilient member. The actuator is operable, when actuated, to move the resilient member to rotate the link arm about the pivot and thereby cause compression of the bunch of sheets by the pressure plate using a force from the resilient member that reduces as the resilient member relaxes in response to the pressure plate moving as sheets are removed from the bunch of sheets.

15 Claims, 6 Drawing Sheets

FIG. 3
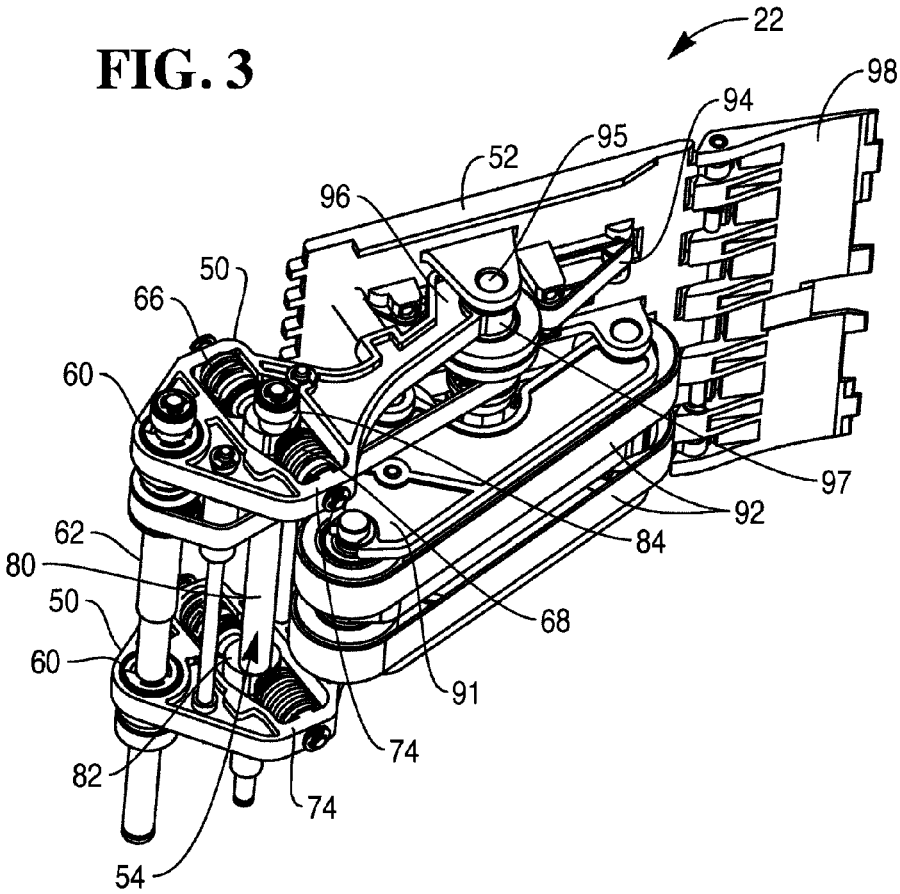
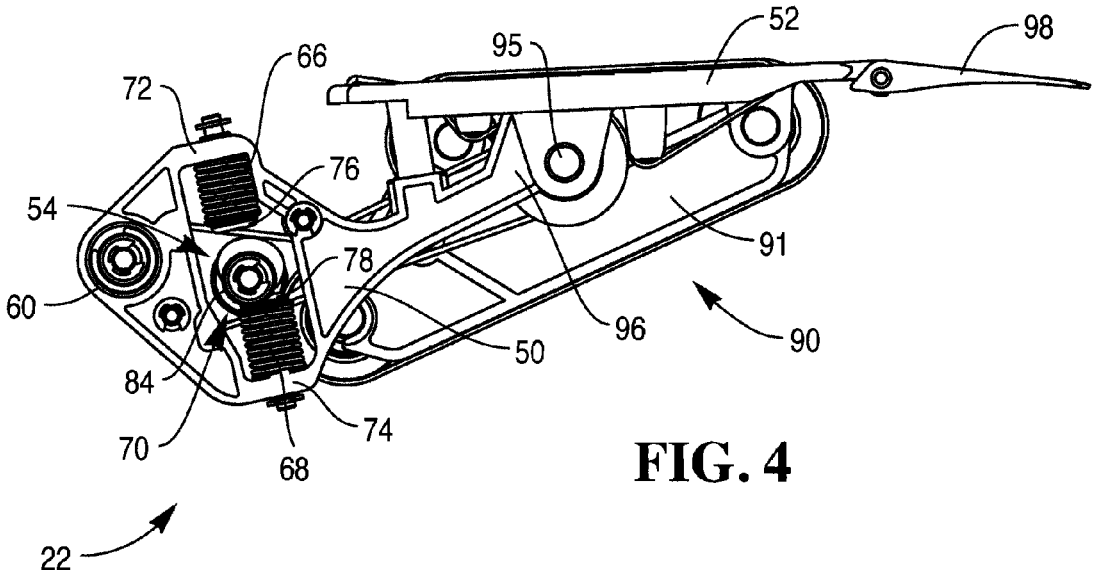
FIG. 4

FIG. 11
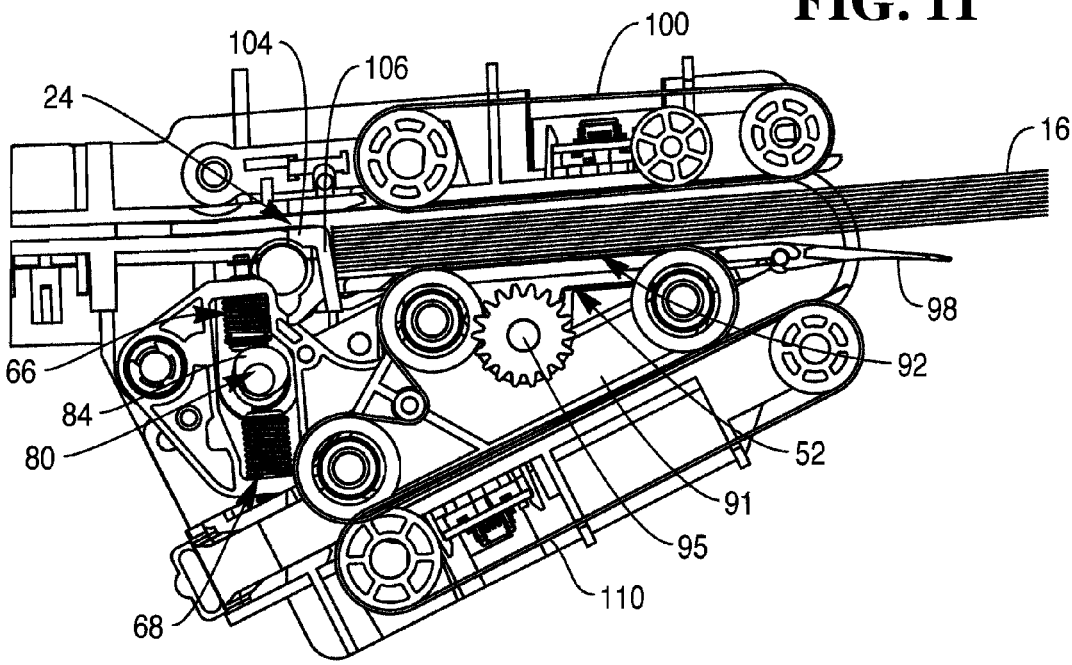
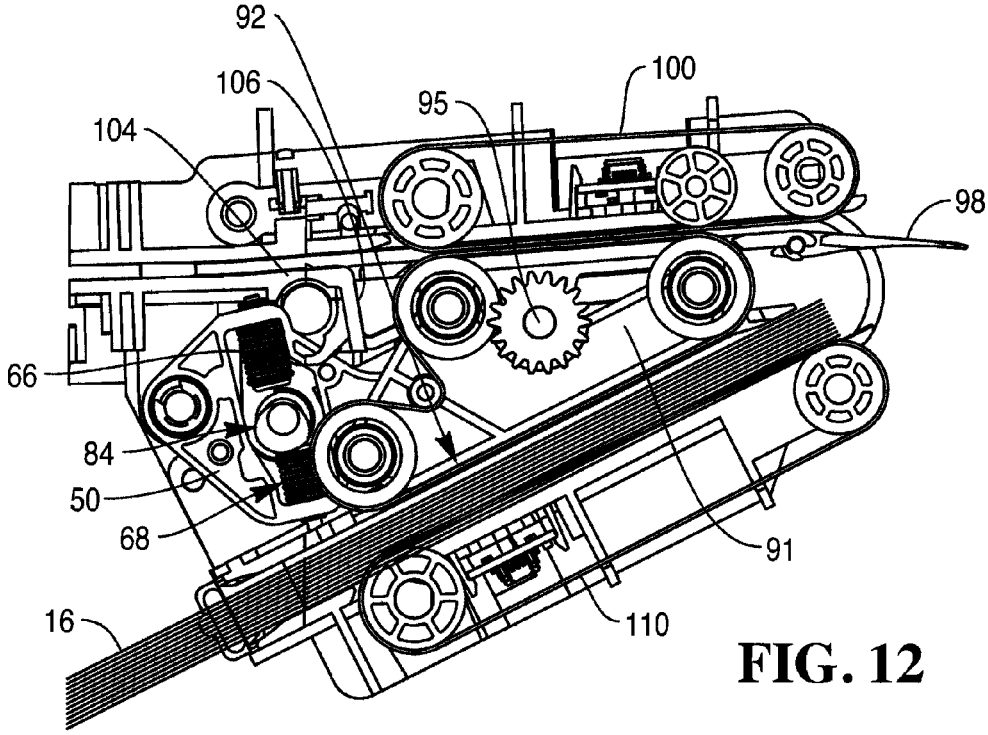
FIG. 12

MEDIA DEPOSITORY

FIELD OF INVENTION

The present invention relates to improvements in, or relating to, a media depository.

BACKGROUND OF INVENTION

Media depositories are used to receive media items from a customer. One common type of media depository is a sheet media depository for receiving media items in sheet form (such as banknotes, cheques, tickets, giros, and the like).

Sheet media depositories are used in ATMs and other self-service terminals (such as vending machines, change machines, and the like) to identify and validate deposited sheets.

Some sheet depositories are capable of receiving a bunch of sheets in a loading area and then picking individual sheets from the bunch so that each sheet can be identified and validated individually prior to storage of the validated sheet within the depository. These depositories are referred to herein as "bunch sheet depositories". Bunch sheet depositories may transport the bunch from the loading area to the picking area, or the picking area may be adjacent the loading area.

It is desirable to provide bunch sheet depositories that can accept a large bunch of sheets. However, when a large bunch of sheets has to be transported to the picking area there is a tendency for sheets within the bunch to splay out prior to reaching the picking area. This makes picking the sheets less reliable.

Furthermore, some customers will only insert a small number of sheets (such as one banknote and/or cheque) into the bunch depository; whereas, other customers will insert the maximum permissible number of sheets (for example, fifty media items) into the bunch depository. It is important to be able to provide an appropriate force on the bunch, regardless of the size of the bunch.

SUMMARY OF INVENTION

Accordingly, the invention generally provides methods, systems, and apparatus for an improved media depository.

In addition to the Summary of Invention provided above and the subject matter disclosed below in the Detailed Description, the following paragraphs of this section are intended to provide further basis for alternative claim language for possible use during prosecution of this application, if required. If this application is granted, some aspects may relate to claims added during prosecution of this application, other aspects may relate to claims deleted during prosecution, other aspects may relate to subject matter never claimed. Furthermore, the various aspects detailed hereinafter are independent of each other, except where stated otherwise. Any claim corresponding to one aspect should not be construed as incorporating any element or feature of the other aspects unless explicitly stated in that claim.

According to a first aspect there is provided a bunch sheet depository comprising:

a pressure plate for pressing on a bunch of sheets;

a picker aligned with the pressure plate and arranged to remove sheets individually from the bunch of sheets;

a link arm including (i) a pivot, (ii) an urging portion coupled to the pressure plate and (iii) a resilient member; and an actuator coupled to the resilient member and operable, when actuated, to compress the resilient member to pivot the link arm and thereby cause compression of the bunch of sheets by the pressure plate using a force that reduces as the pressure plate moves in response to sheets being removed from the bunch of sheets by the picker.

The pressure plate may receive a bunch of sheets on an upper surface thereof. Alternatively, the pressure plate may push downwards on a bunch of sheets. In other words, in some embodiments the pressure plate may act on a top sheet of a bunch of sheets; whereas, in other embodiments, the pressure plate may act on a bottom sheet of a bunch of sheets.

Where the pressure plate pushes up on the bottom of a bunch of sheets, the picker may pick individual sheets from the top of the bunch. Where the pressure plate pushes down on the top of a bunch of sheets, the picker may pick individual sheets from the bottom of the bunch.

Where the pressure plate pushes up on the bottom of a bunch of sheets, the resilient member may be selected so that the reduction in the spring force applied by the resilient member as a sheet is removed approximately matches the weight of the removed sheet so that a relatively constant pinch force is applied to the bunch of sheets as sheets are removed. Providing a generally constant pinch force to a bunch of sheets, even as individual sheets are removed from the bunch, enables a picking operation to be performed more reliably.

In some embodiments, the resilient member may be selected to have a stiffness k within the range of 0.05 N/mm to 1.00 N/mm. In embodiments where the resilient member is to be used with bunches of banknotes, or mixed cheque and banknote bunches, the resilient member may be selected to have a stiffness k within the range of 0.07 N/mm to 0.09 N/mm. In one embodiment, the stiffness k may be selected to be approximately 0.08 N/mm.

The term "bunch loader" may be used herein to describe the combination of, inter alia, the pressure plate, the link arm, and the actuator.

The bunch loader may further comprise a transport arrangement. The transport arrangement may comprise: (i) a chassis, (ii) a pivot shaft mounted to the chassis, and (iii) a combination of one or more skid plates, one or more stretchable endless belts, one or more rollers, or any other conventional sheet drive mechanism. The pressure plate may include a hub that is mounted onto the pivot shaft to allow the pressure plate to pivot about the pivot shaft. The urging portion may also define a hub that is mounted to the pivot shaft, so that the pressure plate and the urging portion are coupled via the pivot shaft.

The picker may comprise a registration edge against which a bunch of sheets is driven to maintain the bunch of sheets in registration therewith, a pick surface adjacent the registration edge and movable in a forward direction when picking individual sheets, and a retard surface opposite the pick surface and also adjacent the registration edge. The retard surface may be movable in a reverse direction when picking individual sheets. The pick surface and/or the retard surface may be defined by a roller, a belt, a wheel, or the like.

The pivot may define a hub for mounting on a link arm pivot shaft. The hub may be disposed at an opposite end of the link arm to the urging portion to maximise displacement of the urging portion as the pivot rotates about the link arm pivot shaft.

The link arm pivot shaft may be used as a drive shaft to drive belts or rollers in the transport arrangement.

The link arm may further comprise a cam follower coupled to the resilient member, and arranged to abut to a portion of the actuator.

The actuator may comprise a rotatable shaft including a cam axially mounted thereon. Rotation of the shaft may cause the cam to engage with the cam follower and thereby pivot the link arm to provide movement to the pressure plate. The cam may be generally teardrop-shaped.

The resilient member may comprise a coil spring, a leaf spring, a gas spring, or any other convenient spring.

The link arm may comprise a yoke link arm. The yoke link arm may include a pair of resilient members (an upper resilient member and a lower resilient member), disposed on opposing sides of the actuator rotatable shaft, each resilient member including a cam follower (an upper and lower cam follower, respectively), so that as the shaft rotates the cam on the shaft deflects, and then allows relaxation of, the upper cam follower, and then deflects, and allows relaxation of, the lower cam follower.

The yoke link arm urging portion may also be coupled to the transport arrangement. The transport arrangement may include an upper portion of a lower sheet transporter. The upper portion of the lower sheet transporter may comprise one or more stretchable endless belts looping around rollers mounted on shafts, or any other convenient drive mechanism.

A lower portion of the lower sheet transporter may comprise one or more of the following: a skid plate, a stretchable endless belt, and/or a roller.

The lower sheet transporter may be operable to present sheets to a customer. The sheets may have been inserted by the customer as part of a bunch of sheets (that is, the sheets are being returned to the customer, for example, because the sheets are invalid, not recognised, or the customer desires to cancel the transaction), or the sheets may have been stored within the bunch sheet depository as a result of an earlier transaction (that is, the depository may operate as a sheet recycler).

When the lower cam follower is actuated, the yoke link arm urging portion may push the upper portion of the lower sheet transporter onto a bunch of sheets being transported for presenting to the customer.

The depository may comprise a pair of yoke link arms, each mounted on the actuator rotatable shaft. The actuator rotatable shaft may include two cams mounted thereon, and each cam may be aligned with upper and lower cam followers on a respective one of the yoke link arms.

A yoke link arm has the advantage that it can (i) urge a pressure plate upwards to provide an appropriate pinch force to a bunch of sheets being inserted into the depository, or (ii) urge an upper portion of the lower sheet transporter downwards to provide a force on a bunch of sheets to enable transport of the sheets as a bunch to the customer.

The depository may further comprise conventional features of a depository, such as a validator arranged to recognise and validate individual sheets; an internal transport section arranged to transport individual sheets from the picker to the validator; an escrow for temporarily storing sheets that have been inserted and passed through the validator; a storage area for storing deposited sheets; a communications circuit; a depository controller; and the like.

The bunch sheet depository may be a banknote depository, a cheque depository, a combined cheque and banknote depository, a financial document depository (banknotes, cheques, giros, and the like), or the like.

It will now be appreciated that this aspect of the invention has the advantage that a resilient member (such as a spring) is used to impart force to a pressure plate. The pressure plate moves as individual sheets are removed from a bunch compressed by the pressure plate, which cause the resilient member to return to nearer its quiescent state, thereby reducing the spring force applied by the resilient member to the pressure plate. When this is used to push up on a bottom surface of a bunch of sheets, the spring force reduction can be matched to the weight of a sheet so that a generally constant pinch force can be applied to the bunch of sheets regardless of the size of the bunch of sheets, and even though individual sheets are being removed from the bunch.

According to a second aspect there is provided a self-service terminal including the bunch sheet depository of the first aspect.

The self-service terminal may be an automated teller machine (ATM), an information kiosk, a financial services centre, a bill payment kiosk, a lottery kiosk, a postal services machine, a check-in and/or check-out terminal such as those used in the retail, hotel, car rental, gaming, healthcare, and airline industries, or the like.

According to a third aspect there is provided a bunch loader for a bunch sheet depository, the bunch loader comprising:

a pressure plate for applying pressure to a bunch of sheets;

a link arm including (i) a pivot, (ii) an urging portion coupled to the pressure plate and (iii) a resilient member; and an actuator coupled to the resilient member and operable, when actuated, to move the resilient member to rotate the link arm about the pivot and thereby cause compression of the bunch of sheets by the pressure plate using a force from the resilient member that reduces as the resilient member relaxes in response to the pressure plate moving as sheets are removed from the bunch of sheets.

According to a fourth aspect there is provided method of applying a controlled pinch force to a bunch of sheets inserted into a depository, the method comprising:

receiving a bunch of sheets;

activating an engagement mechanism to urge a resilient member to a compressed position;

using the compressed resilient member to pivot a link arm to apply pressure to the bunch of sheets;

picking individual sheets from the bunch;

allowing the resilient member to expand from the compressed position as sheets are removed from the bunch of sheets to ensure that a controlled force is applied to the bunch of sheets.

The method may further comprise: de-activating the engagement mechanism to allow the resilient member to return to a quiescent (relatively uncompressed) position.

The resilient member may be partially compressed in the quiescent position, but it should not be as compressed as when it is in the compressed position.

According to a fifth aspect there is provided a bunch sheet depository comprising:

a pressure plate for receiving a bunch of sheets on an upper surface thereof;

a picker arranged to remove sheets individually from the bunch of sheets on the pressure plate;

a link arm including (i) a pivot, (ii) an urging portion coupled to the pressure plate and (iii) a resilient member; and an actuator coupled to the resilient member and operable, when actuated, to move the link arm about the pivot and thereby provide upward movement to the pressure plate, the resilient member being operable to provide upward pressure that reduces as the pressure plate rises in response to sheets being removed from the bunch by the picker.

According to a sixth aspect there is provided a method of applying a controlled pinch force to a bunch of sheets inserted into a depository, the method comprising:

receiving a bunch of sheets;

moving a resilient member to a compressed position;

using the compressed resilient member to pivot a link arm to apply pressure to the bunch of sheets;

picking individual sheets from the bunch; and allowing the resilient member to expand from the compressed position as sheets are removed from the bunch of sheets to ensure that a reduced spring force is applied to the bunch of sheets as individual sheets are picked from the bunch, but a relatively constant pinch force is applied to the bunch of sheets due to the reduction in weight of the bunch of sheets.

For clarity and simplicity of description, not all combinations of elements provided in the aspects recited above have been set forth expressly. Notwithstanding this, the skilled person will directly and unambiguously recognise that unless it is not technically possible, or it is explicitly stated to the contrary, the consistory clauses referring to one aspect are intended to apply mutatis mutandis as optional features of every other aspect to which those consistory clauses could possibly relate.

These and other aspects will be apparent from the following specific description, given by way of example, with reference to the accompanying drawings.

BRIEF DESCRIPTION OF THE DRAWINGS

FIG. 3 is a diagram of the bunch loader of FIG. 2 shown as a perspective view from below;

FIG. 4 is a diagram of the bunch loader of FIG. 2 shown as a side view;

FIG. 11 is a simplified diagram showing the parts of FIG. 5 holding a bunch of sheets at a picking point; and FIG. 12 is a simplified diagram showing the parts of FIG. 8 holding a bunch of sheets near a customer return point.

DETAILED DESCRIPTION

Figure 1:
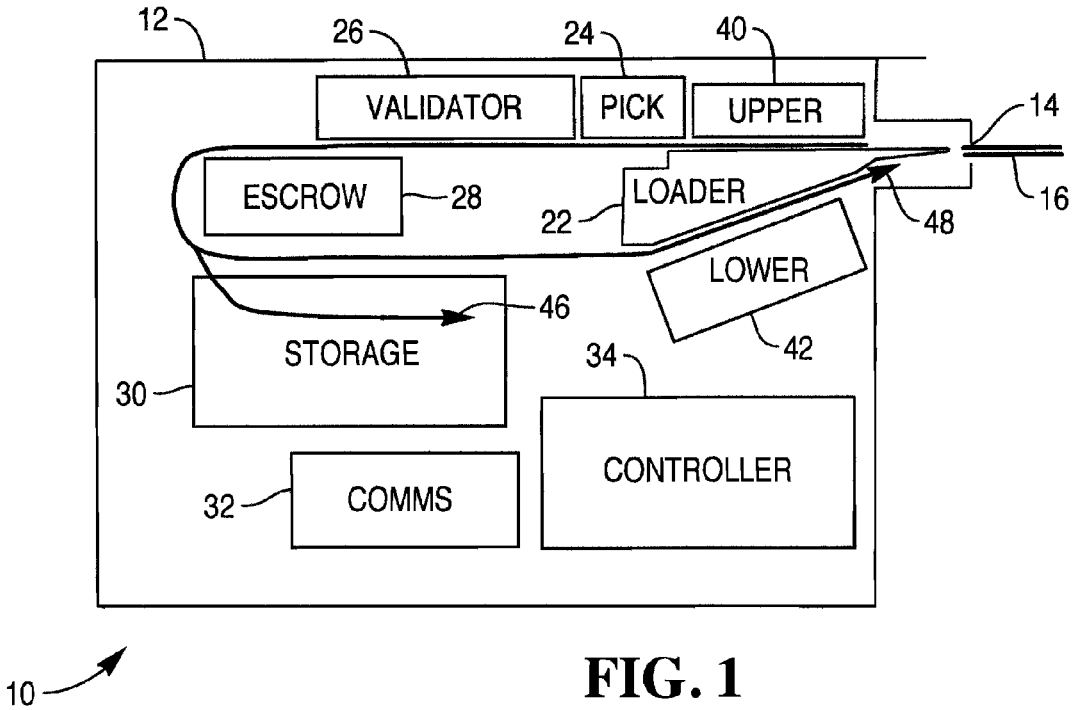
FIG. 1 is a simplified schematic diagram of a bunch sheet depository according to one embodiment of the present invention.

Reference will now be made to FIG. 1, which is a simplified schematic diagram of a bunch sheet depository 10 according to one embodiment of the present invention. The depository 10 is operable to receive bunches of banknotes and/or cheques from a customer.

The depository 10 includes a chassis 12 onto which various parts are mounted. The depository 10 further comprises: a bunch deposit slot 14 into which a bunch of sheets 16 can be deposited; a bunch loader 22; a picker 24 aligned with the bunch loader 22 for removing individual sheets from the bunch (or stack) of sheets 16; a sheet validator 26; an escrow 28 for temporarily holding validated sheets until a customer confirms that he/she wants to complete the transaction; a storage compartment 30; a communications circuit board 32 for communicating with a self-service terminal (not shown) into which the depository 10 may be installed; and an onboard controller 34 for controlling the operation of the depository 10.

The depository 10 includes a plurality of sheet transport sections, only some of which will be described herein. An upper sheet transport section 40 is located above the bunch loader 22 and adjacent the picker 24. A lower sheet transport section 42 is located beneath the bunch loader 22 and near the bunch deposit slot 14.

The bunch loader 22 is used to transport deposited banknotes from the bunch deposit slot 14 to the picker 24.

There are two different routes that can be taken by a sheet that is inserted into the depository 10. The first route is shown by arrow 46 and involves the sheet being picked from the bunch of sheets 16, transported to the picker 24, moved past the validator 26 to be identified and validated, placed in the escrow 28, and from the escrow 28 transported into the storage compartment 30.

The second route is shown by arrow 48 and involves the sheet being picked from the bunch of sheets 16, transported to the picker 24, moved past the validator 26 to be identified and validated, placed in the escrow 28, and from the escrow 28 returned to the customer via the lower sheet transporter 42.

As is known in the art, whether a sheet is stored (that is, follows the first route 46 in this embodiment) or returned to the customer (that is, the second route 48 in this embodiment) depends on a number of factors, such as: whether the sheet is recognised, whether the sheet is validated, whether the customer cancels or confirms the transaction, and the like.

Figure 2:
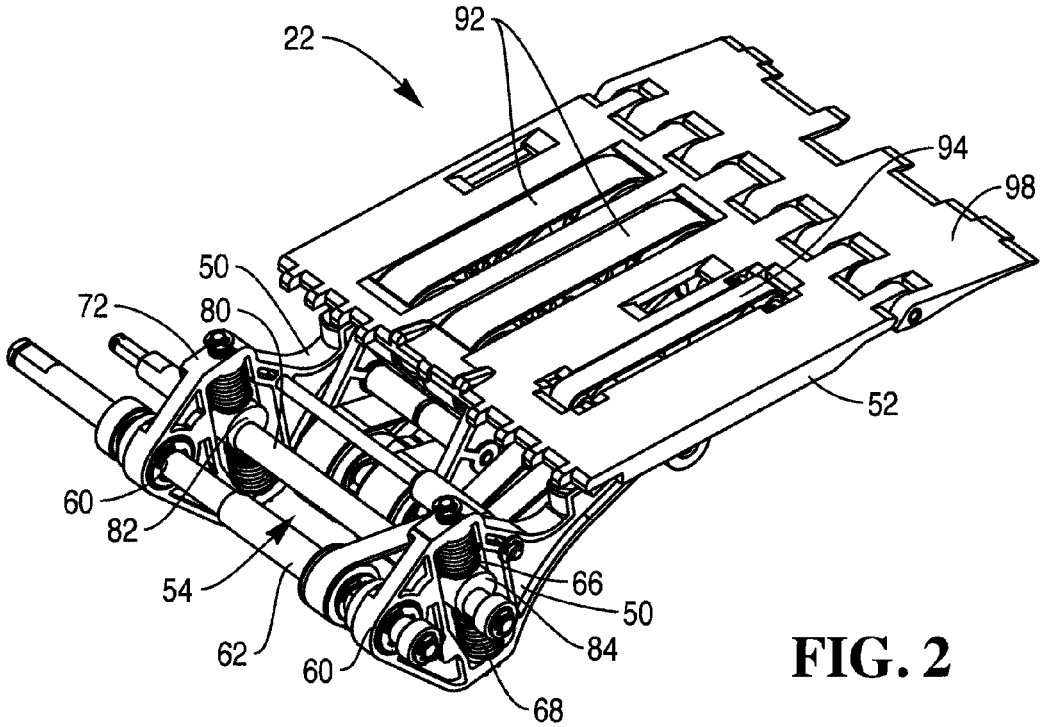
FIG. 2 is a diagram showing part (a bunch loader) of the depository of FIG. 1 in more detail as a perspective view from above.

Reference will now be made to FIGS. 2 to 4, which illustrate the bunch loader 22 in more detail.

The bunch loader 22 comprises: a pair of link arms 50; a pressure plate 52; and an actuator 54. To aid clarity, not all reference numerals will be shown in all of the drawings.

Each link arm 50 defines a pivot 60, in the form of a hub that is mounted on a link arm pivot shaft 62. The link arm pivot shaft 62 operates as a drive shaft, as will be described below.

Each link arm 50 also includes an upper resilient member 66 and a lower resilient member 68 mounted opposite each other with a gap therebetween. The resilient members 66,68 are in the form of coil springs.

Each link arm 50 defines a central area 70 (the gap between the upper and lower coil springs 66,68) through which the actuator 54 protrudes. Each coil spring 66,68 is mounted to the link arm 50 at a fixed end 72,74 respectively, and is coupled to a cam follower 76,78 respectively, near the centre of the central area 70 (between the opposing fixed ends 72,74). Thus, the upper coil spring 66 is coupled to the upper cam follower 76, and the lower coil spring 68 is coupled to the lower cam follower 78.

The actuator 54 comprises a rotating shaft 80 on which are mounted two cams 82,84, one cam 82,84 for each link arm 50. Each cam (for example, cam 82) is aligned with the respective cam followers 76,78 of the associated link arm 50.

The cams 82,84 are generally teardrop-shaped and are aligned in registration on the shaft 80, so that as the shaft 80 rotates, the cams 82,84 both engage with the upper cam follower 76 to compress the upper coil spring 66, and then both disengage from the upper cam follower 76 to allow the upper coil spring 66 to relax to its quiescent state. Further rotation of the shaft 80 causes both of the cams 82,84 to engage with the lower cam follower 78 to compress the lower coil spring 68, and then disengage from the lower cam follower 78 to allow the lower coil spring 68 to relax to its quiescent state.

The bunch loader 22 also includes a transport arrangement 90 powered by the drive shaft 62. The transport arrangement 90 co-operates with both the upper sheet transport section 40 and the lower sheet transport section 42.

The transport arrangement 90 comprises: a chassis 91 including shafts and wheels (not individually labelled in the drawings), a pair of belts 92 mounted to the chassis 91, a single thinner belt 94 also mounted on the chassis 91, and a pivot shaft 95 about which both the link arms 50 and the chassis 91 can pivot.

The three belts 92,94 all protrude through the pressure plate 52 (best shown by FIG. 2) for transporting the bunch of sheets 16 to the picker 24. The pair of belts 92 also extend beneath the pressure plate 52 (best shown by FIG. 3) to provide a transport section that co-operates with the lower sheet transport section 42.

Each link arm 50 is also pivotably coupled to the pressure plate 52 by an urging portion 96. The urging portion 96 defines a hub 97 mounted on the pivot shaft 95 of the transport arrangement 90. The pressure plate 52 is also mounted on the pivot shaft 95. As the urging portion 96 moves upwards, the transport arrangement 90 and the pressure plate 52 move upwards; as the urging portion 96 moves downwards, the transport arrangement 90 and the pressure plate 52 move downwards.

As will be explained in more detail below, rotation of the actuator shaft 80 can be used to pivot the urging portion 96 upwards to cause the pressure plate 52 and the transport arrangement 90 to rise. Further rotation of the actuator shaft 80 can be used to pivot the urging portion 96 downwards to cause the pressure plate 52 and the transport arrangement 90 to fall.

A flap 98 is coupled to an end of the pressure plate 52 near to the bunch deposit slot 14. This flap 98 allows a bunch 16 of sheets to be transported over the sheet return path (route 48) when the bunch 16 of sheets is being inserted; but it can also be deflected by a bunch of sheets being transported to the bunch deposit slot 14 in the event that one or more sheets have to be returned to the customer.

Reference will now be made to FIGS. 5 to 12, which illustrate the bunch loader 22, the upper sheet transport section 40, and the lower sheet transport section 42 in more detail. Again, for clarity, not all reference numerals are shown on these drawings.

Figure 5:
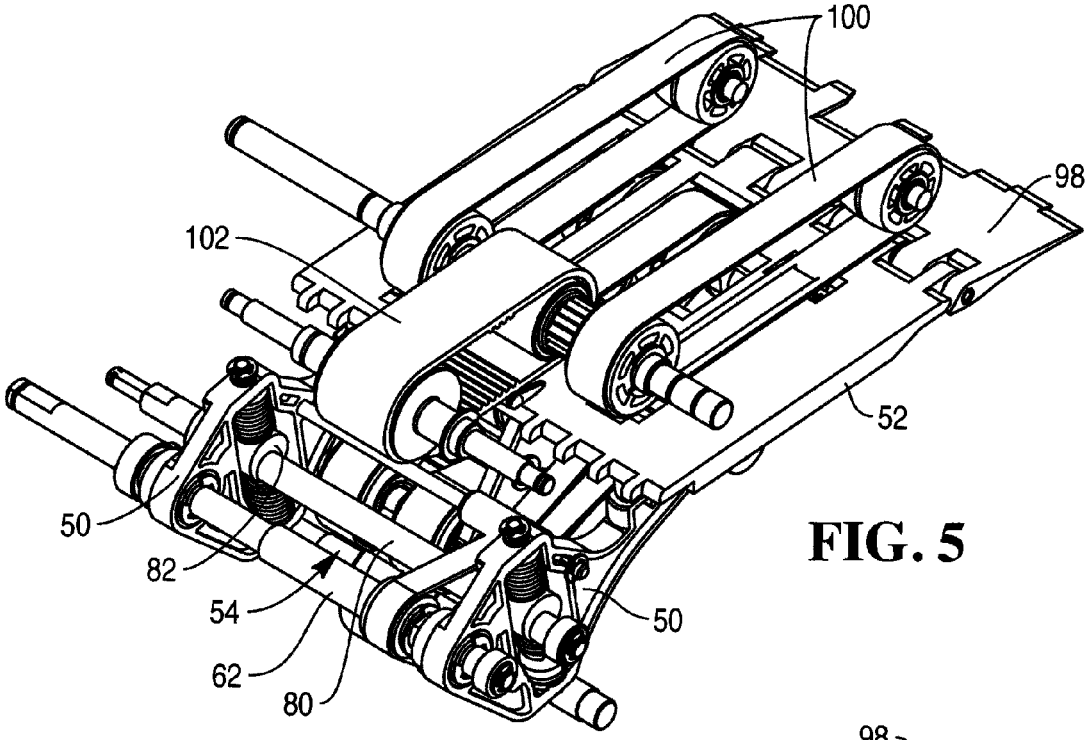
FIG. 5 is a diagram showing parts (the bunch loader, an upper sheet transport section, and a lower sheet transport section) of the depository of FIG. 1 as a perspective view from above, where the pressure plate is urged towards the upper sheet transport section.
Figure 6:
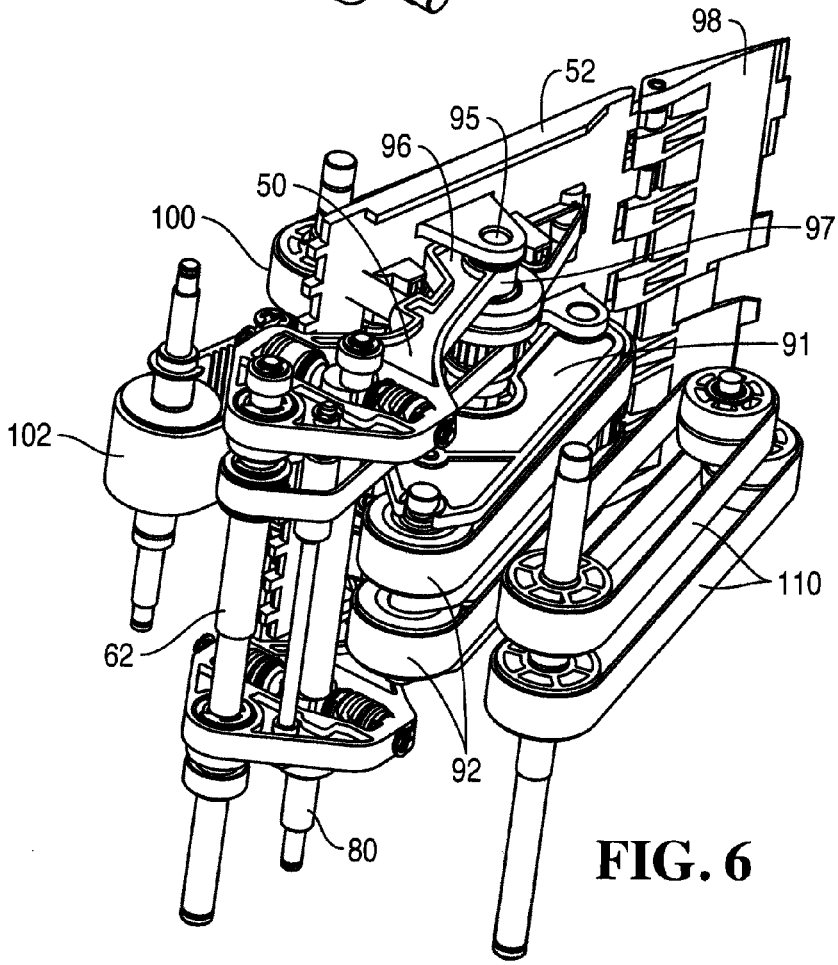
FIG. 6 is a diagram showing the parts of FIG. 5, as a perspective view from below.
Figure 7:
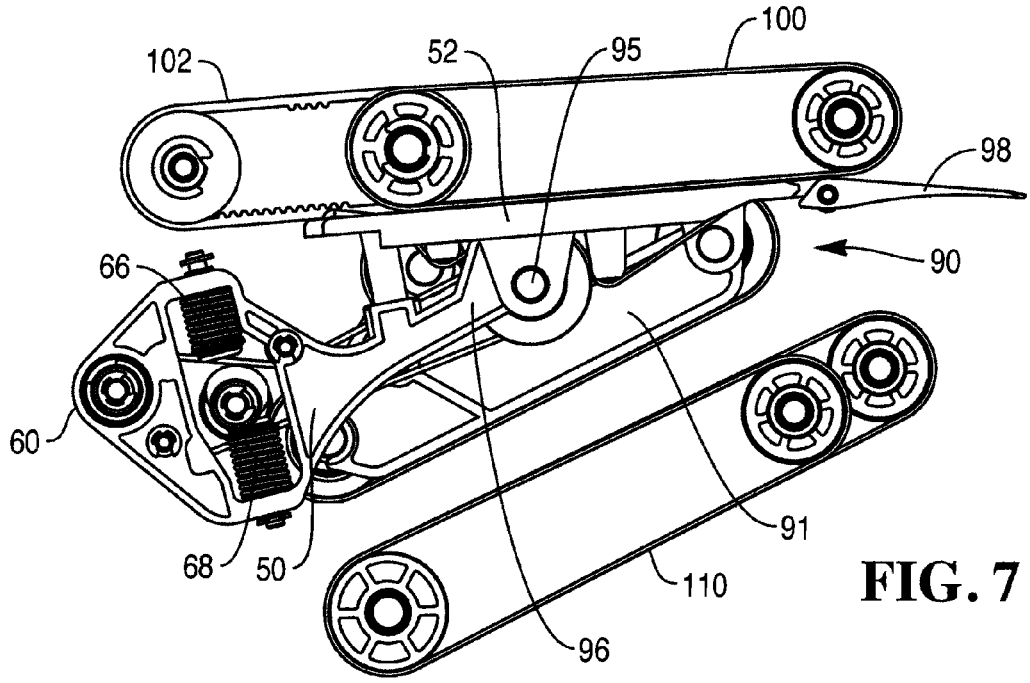
FIG. 7 is a diagram showing the parts of FIG. 5, as a side view.
Figure 8:
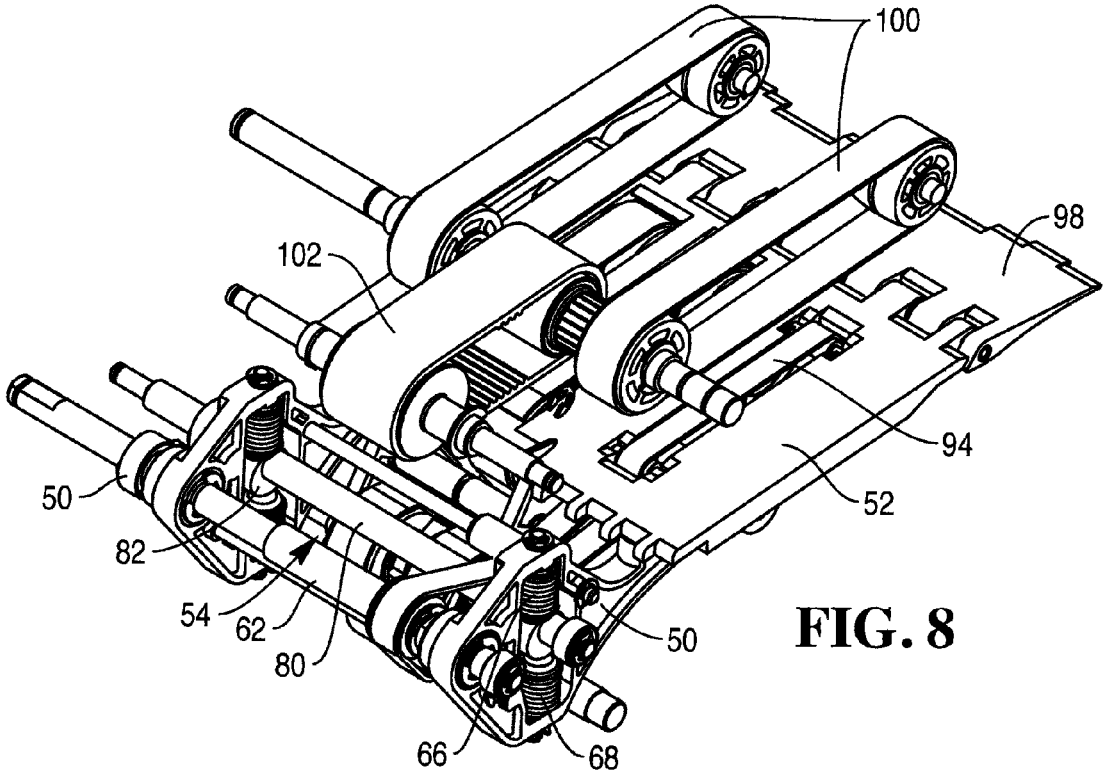
FIG. 8 is a diagram showing the parts of the depository of FIG. 5 as a perspective view from above, where the pressure plate is urged towards the lower sheet transport section.
Figure 9:
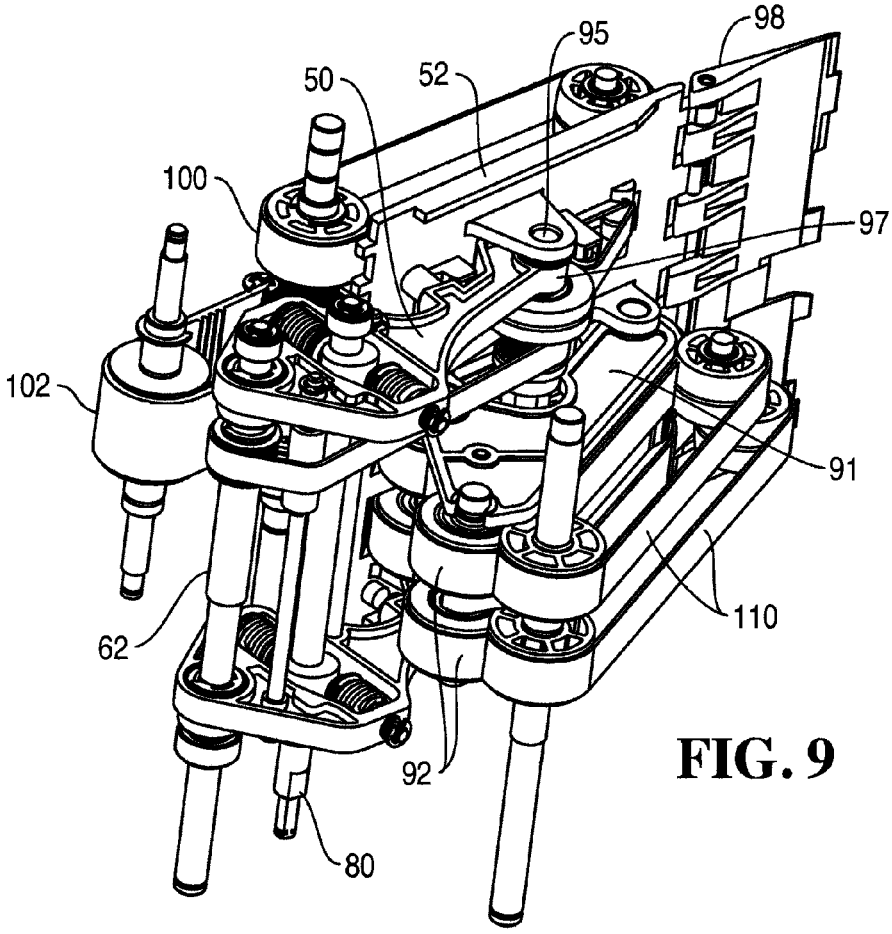
FIG. 9 is a diagram showing the parts of FIG. 8, as a perspective view from below.
Figure 10:
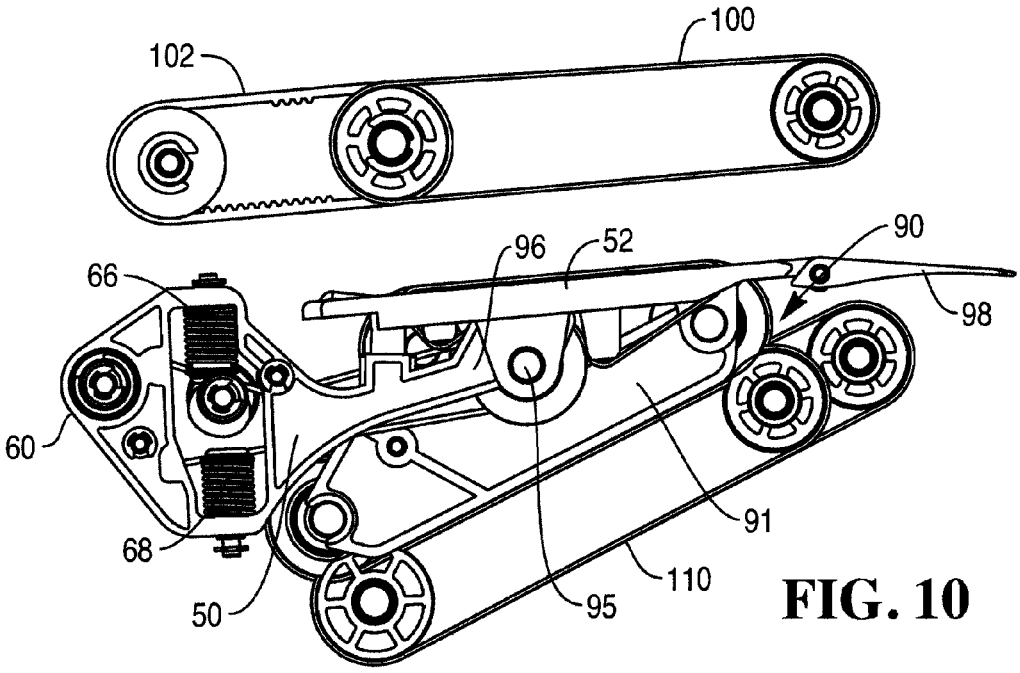
FIG. 10 is a diagram showing the parts of FIG. 8, as a side view.

FIGS. 5 to 7 illustrate the bunch loader 22 driven to an upper position, which is used when the bunch 16 of sheets is inserted into the depository 10; and FIGS. 8 to 10 illustrate the bunch loader 22 driven to a lower position, which is used when a bunch of sheets is being returned to a customer.

Referring first to FIGS. 5 to 7, the upper sheet transport section 40 comprises: a pair of transport belts 100 for moving an inserted bunch 16 towards the picker 24. The picker 24 includes a pick belt 102 having a high friction surface for picking the topmost sheet from the bunch 16.

Although not illustrated in FIGS. 5 to 7, the picker 24 also includes a retard belt 104 (FIGS. 11 and 12) that moves in the opposite direction to the pick belt 102 to reduce the possibility of picking multiple sheets at a time. The picker 24 also includes a registration edge 106 (FIGS. 11 and 12) against which the bunch 16 of sheets is driven prior to (and optionally during) the pick operation. Such retard belts 104 are well known to those of skill in the art.

The lower sheet transport section 42 comprises a pair of belts 110 that cooperate with the pair of belts 92 in the transport arrangement 90.

The controller 34 is responsible for energising all of the transport sections within the depository 10, rotating the actuator shaft 80, energising the picker 24, and all other electrical and electro-mechanical operations of the depository 10.

Insertion of Sheet Bunch

As shown in FIGS. 5 to 7 and 11, when a bunch 16 of sheets (such as banknotes) is inserted into the bunch deposit slot 14, the controller 34 detects this and energises the transport arrangement 90 and the upper sheet transport section 40 to draw the bunch 16 into the depository 10. The controller 34 also energises the actuator 54 and rotates the actuator shaft 80 until the cams 82,84 impart maximum displacement to the upper cam followers 76. In this position, the lower cam followers 78 are not displaced.

Displacement of the upper cam followers 76 causes both of the upper coil springs 66 to be compressed. This, in turn, causes both of the link arms 50 to pivot about pivot 60 so that the urging portion 96 of each rises. When the urging portions 96 rise, the pressure plate 52 also rises. This has the effect of compressing the bunch 16, which ensures that banknotes within the bunch 16 are not splayed during transport. Since the pressure plate 52 is pivotably coupled to the urging portion 96, the pressure plate 52 remains parallel to the bunch 16 as the pressure plate 52 rises.

Once the bunch 16 reaches the picker 24, the picker 24 removes banknotes one at a time. Each banknote that is removed enables the pressure plate 52 to rise a little. This allows the upper coil springs 66 to expand (that is, to relax), which reduces the pressure that the upper coil springs 66 apply to the remaining banknotes in the bunch 16. FIG. 11 illustrates the bunch 16 at the picker 24. FIG. 7 illustrates the pressure plate 52 urged against the upper sheet transport section 40.

Once all of the banknotes in the bunch 16 have been picked, the controller 34 de-activates the actuator 54 by rotating the actuator shaft 80 until the cams 82,84 cease to displace the upper cam followers 76. This allows the pressure plate 52 to fall back to its normal position because the link arms 50 are equally biased by the upper and lower coil springs 66,68.

It should be noted that in FIGS. 11 and 12 one of the link arms 50 has been removed for clarity.

Return of Sheet Bunch to a Customer

When the depository 10 is to return one or more sheets to a customer, then the controller 34 actuates the bunch loader 22 as illustrated in FIGS. 8 to 10 and 12. The controller 34 energises transport sections (not shown in detail) within the depository 10 to transport the bunch 16 of sheets towards the lower transport section 42.

The controller 34 also energises the actuator 54 and rotates the actuator shaft 80 until the cams 82,84 impart maximum displacement to the lower cam followers 78. In this position, the upper cam followers 76 are not displaced.

Displacement of the lower cam followers 78 causes both of the lower coil springs 68 to be compressed. This, in turn, causes both of the link arms 50 to pivot about pivot 60 so that the urging portion 96 of each moves downwards. When the urging portions 96 move down, the pressure plate 52 also moves down (best seen in FIG. 10). This has the effect of compressing the bunch 16 between (i) the pair of belts 92 on the transport arrangement 90 and (ii) the pair of belts 110 on the lower transport section 42. This ensures that banknotes within the bunch 16 are not splayed during transport towards the bunch deposit slot 14. As the bunch 16 approaches the bunch deposit slot 14, the bunch deflects the flap 98 upwards and then partially exits the bunch deposit slot 14 for the customer to retrieve.

Once the bunch 16 has been removed by the customer, the controller 34 de-activates the actuator 54 by rotating the actuator shaft 80 until the cams 82,84 cease to displace the lower cam followers 78. This allows the pressure plate 52 to fall back to its normal position because the link arms 50 are equally biased by the upper and lower coil springs 66,68.

It should now be appreciated that this embodiment has the advantage that a bunch of sheets can be transported and the sheets individually picked, while a pressure plate automatically applies an appropriate pressure to the bunch depending on the size of the bunch. Because a yoke link arm is used in the above embodiment (that is, a link arm having a pair of springs mounted thereto), the same mechanism can be used for drawing sheets into the depository and transporting sheets out of the depository.

Various modifications may be made to the above described embodiment within the scope of the invention, for example, in other embodiments, a different resilient member may be used, such as a leaf spring.

In other embodiments, only a single link arm, or more than two link arms, may be used. In other embodiments, each link arm may only include a single resilient member rather than a pair of opposed resilient members.

In other embodiments, the resilient members may be extended rather than compressed to pivot the link arms.

In other embodiments, the actuator may comprise a linkage rather than a shaft and cams.

In other embodiments, different transport sections may be used than those described. Transport sections may use different sheet drive mechanisms than those described above.

The steps of the methods described herein may be carried out in any suitable order, or simultaneously where appropriate.

The terms "comprising", "including", "incorporating", and "having" are used herein to recite an open-ended list of one or more elements or steps, not a closed list. When such terms are used, those elements or steps recited in the list are not exclusive of other elements or steps that may be added to the list.

Unless otherwise indicated by the context, the terms "a" and "an" are used herein to denote at least one of the elements, integers, steps, features, operations, or components mentioned thereafter, but do not exclude additional elements, integers, steps, features, operations, or components.

What is claimed is:

1. A bunch sheet depository comprising:

a pressure plate for pressing on a bunch of sheets;

a picker aligned with the pressure plate and arranged to remove sheets individually from the bunch of sheets;

a link arm including (i) a pivot, (ii) an urging portion coupled to the pressure plate and (iii) a resilient member; and an actuator coupled to the resilient member and operable to tighten the resilient member, wherein the resilient member, when compressed, applies a force to rotate the link arm about the pivot and to move the pressure plate to press on the bunch of sheets;

wherein the force from the resilient member reduces as the resilient member relaxes in response to the pressure plate moving as sheets are removed from the bunch of sheets.

2. A depository according to claim 1, wherein the pressure plate includes an upper surface which presses on the bunch of sheets.

3. A depository according to claim 1, wherein the picker removes sheets from the bunch of sheets beginning with a top sheet.

4. A depository according to claim 1, further comprising a sheet transport arrangement.

5. A depository according to claim 4, wherein the sheet transport arrangement comprises a chassis and a pivot shaft mounted to the chassis, and wherein the urging portion and the pressure plate are mutually coupled with the chassis via the pivot shaft.

6. A depository according to claim 1, wherein the picker comprises a registration edge, a pick surface movable in a forward direction when picking individual sheets, and a retard surface.

7. A depository according to claim 1, wherein the pivot includes a hub and is disposed at an opposite end of the link arm to the urging portion.

8. A depository according to claim 1, wherein the link arm further comprises a cam follower coupled to the resilient member, and arranged to abut to a portion of the actuator.

9. A depository according to claim 1, wherein the actuator comprises a rotatable shaft including at least one cam axially mounted thereon.

10. A depository according to claim 9, wherein the actuator comprises two cams axially mounted on the rotatable shaft.

11. A depository according to claim 9, wherein the link arm further comprises another resilient member, the one resilient member and the other resilient member disposed on opposing sides of the rotatable shaft, each of the resilient members including a cam follower, so that as the rotatable shaft rotates, the at least one cam on the rotatable shaft deflects, and then allows relaxation of, each of the cam followers in turn.

12. A depository according to claim 11, wherein the urging portion of the link arm is also coupled to an upper portion of a lower sheet transporter operable to present sheets to a customer.

13. A depository according to claim 1, wherein the resilient member comprises a coil spring.

14. A self-service terminal including the bunch sheet depository of claim 1.

15. A method of controlling separation of individual sheets from a bunch of sheets inserted into a depository, the method comprising:

receiving a bunch of sheets;

moving a resilient member to a compressed position;

using the compressed resilient member to pivot a link arm to apply pressure to the bunch of sheets;

picking individual sheets from the bunch; and allowing the resilient member to expand from the compressed position as sheets are removed from the bunch of sheets to ensure that a reduced spring force is applied to the bunch of sheets as individual sheets are picked from the bunch, but a relatively constant pinch force is applied to the bunch of sheets due to the reduction in weight of the bunch of sheets.

* * * * *